United States Patent [19]

Forss

[11] Patent Number: 4,626,262

[45] Date of Patent: Dec. 2, 1986

[54] EXHAUST AIR SYSTEM FOR ELECTROSTATIC AIR CLEANER

[75] Inventor: John A. Forss, Excelsior, Minn.

[73] Assignee: Honeywell Inc., Minneapolis, Minn.

[21] Appl. No.: 836,265

[22] Filed: Feb. 24, 1986

[51] Int. Cl.[4] ..... B03C 3/36

[52] U.S. Cl. ..... 55/128; 55/385 A; 55/415; 55/472; 98/34.6

[58] Field of Search ..... 55/128, 101, 385 A, 55/415, 413, 472; 98/34.6, 34.5, 31.5

[56] References Cited

U.S. PATENT DOCUMENTS

| | | | |
|---|---|---|---|
| 1,212,450 | 1/1917 | Bunnell | 55/415 X |
| 2,172,771 | 9/1939 | Norris | 98/34.6 X |
| 2,225,070 | 12/1940 | Meyerhoefer | 98/34.5 X |
| 3,421,290 | 1/1969 | Cheney et al. | 55/385 A X |
| 3,618,659 | 11/1971 | Rawal | 55/128 X |
| 3,626,669 | 12/1971 | Cardiff | 55/128 X |
| 4,140,498 | 2/1979 | Krause | 55/385 A X |
| 4,164,901 | 8/1979 | Everett | 55/128 X |
| 4,409,889 | 10/1983 | Burleson | 55/385 A X |
| 4,589,476 | 5/1986 | Berner | 98/34.6 X |

FOREIGN PATENT DOCUMENTS

| | | | |
|---|---|---|---|
| 158749 | 2/1933 | Switzerland | 55/128 |

*Primary Examiner*—Kathleen J. Prunner
*Attorney, Agent, or Firm*—Alfred N. Feldman

[57] ABSTRACT

An electrostatic air cleaner that is supported in the ceiling of a room is modified to vent a portion of the processed air. This venting improves the quality of the air in the occupied space or room. The venting is controlled by a moveable vent closure that has an air diverting portion that can be adjusted along with a sealing portion to regulate the amount of air being diverted from the occupied room.

7 Claims, 4 Drawing Figures

EXHAUST AIR SYSTEM FOR ELECTROSTATIC AIR CLEANER

BACKGROUND OF THE INVENTION

Commercial electronic air cleaners are becoming widely used to improve air quality in individual rooms where groups of people meet. Conference and meeting rooms can many times be heavily populated and include both smokers and non-smokers. When these meeting rooms are in use, typically they are closed off for privacy and the air quality in these meeting areas tends to deteriorate.

In order to overcome some of the air quality problems, electrostatic air cleaners have been designed to flush mount into false or dropped ceiling type structures. The electrostatic air cleaners typically have air intake and discharge grills. The grills are flush mounted in a plane that generally corresponds to the false or dropped ceiling. The electrostatic air cleaner draws air from the meeting room into the air cleaner. The air passes through an electrostatically charged cell where particulates are removed. The air is then discharged back into the room. The air in the room, although low in particulate, may become stale or contain undesirable odors or gases. While most of these type facilities also have fresh make-up air provisions, the total fresh air make-up may not provide a sufficiently high air quality for comfort.

SUMMARY OF THE INVENTION

In the present invention an electrostatic air cleaner means that is designed for installation in a false or dropped ceiling is provided to exhaust up to approximately 20 percent of the air flow through the electrostatic air cleaner. An exhaust air vent is provided in the side of the electrostatic air cleaner and this vent opens into the space between the false or dropped ceiling and the true ceiling for the room in which the electrostatic air cleaner is installed. Typically, this false ceiling area will have a return air duct or in fact forms part of a return air plenum for the ventilating system for the room. By venting a portion of the air that is taken into the electrostatic air cleaner, the room in which it is installed normally will take in fresh make-up air that can be drawn in through the normal ventilating ducts, under doors, or through the normal doorways leading into the occupied space.

The present invention utilizes a very inexpensive but effective way of improving the air quality in an occupied space or meeting room. An exhaust air means is provided with a moveable vent closure with the vent closure including a sealing portion and an adjustable diverting portion. The placement or movement of the vent closure allows the diverting portion to pick off an adjustable percentage of the air being circulated within the electrostatic air cleaner. The portion of the air that is diverted flows to the exhaust air means and out of the room or space that is occupied, and thus undesirable odors and gases are constantly removed from the occupied space.

In accordance with the present invention there is provided an electrostatic air cleaner means for control of the air quality in a room and adapted to be mounted in a drop or false ceiling of said room, including: electrostatic air cleaner means having intake air means and discharge air means mounted in a plane that generally coincides with the plane of said false ceiling for said room in which said electrostatic air cleaner means is installed; said electrostatic air cleaner means creating an air flow into said intake air means where said air flow is treated; said treated air flow being subsequently discharged from said electrostatic air cleaner means; exhaust air means opening above said false ceiling and adapted to vent part of said treated air flow above said false ceiling; said exhaust air means having moveable vent closure means; said vent closure means including a sealing portion and air diverting portion with said air diverting portion being adjustably positioned in said treated air flow to deflect a portion of said air flow through said exhaust air means; and said sealing portion of said vent closure means being moved to a position to regulate the amount of said treated air flow that is vented through said exhaust air means and away from said room in which said electrostatic air cleaner means is installed.

DESCRIPTION OF THE PREFERRED EMBODIMENT

Figure 1:
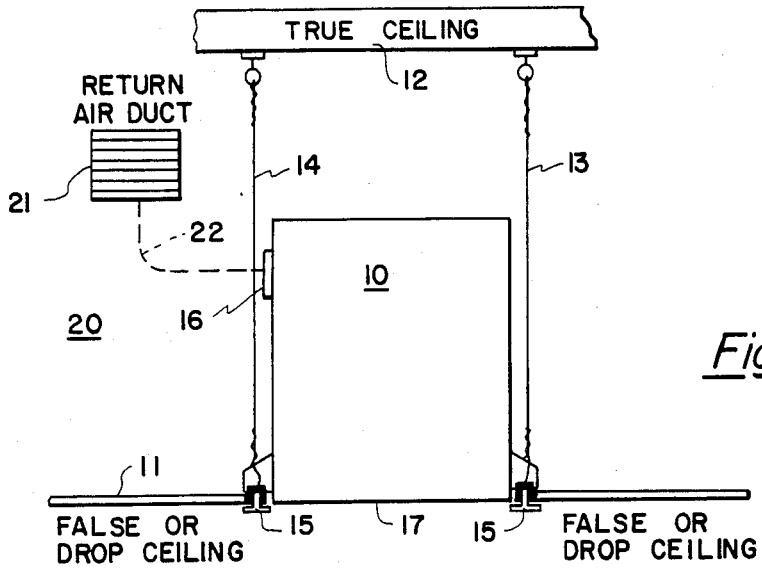
FIG. 1 is a typical installation of an electrostatic air cleaner means.

In FIG. 1 the installation of an electrostatic air cleaner means 10 between a false or dropped ceiling 11 and a true ceiling 12 is disclosed. Electrostatic air cleaner means 10 is supported with a side 17 in a plane generally flush with the false or dropped ceiling 11 by means of wires 13 and 14 that connect between the true ceiling 12 and brackets 15. The brackets 15 form part of the drop ceiling structure. The electrostatic air cleaner means 10 typically would be approximately two feet by two feet or two feet by four feet and would replace one or two two foot square ceiling tiles.

The electrostatic air cleaner means 10 has an exhaust air means 16 on one side. The exhaust air means 16 opens into the space 20 between the true ceiling 12 and the false or dropped ceiling 11. This space 20 is plenum for the heating and ventilating system and typically would include a return air duct 21. The return air duct 21 could be connected, as at 22 by open air, or could be a flexible piece of duct work connected between the return air duct 21 and the exhaust air means 16.

Figure 2:
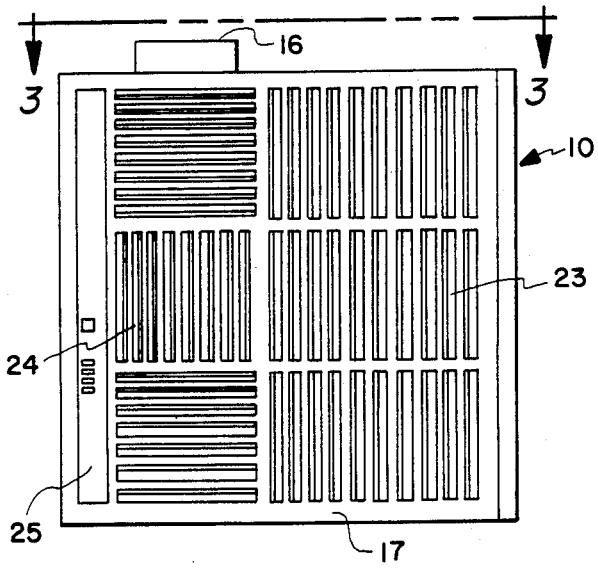
FIG. 2 is a grill which falls in the plane of a false ceiling.

FIG. 2 discloses a view of the grill work of the side 17 of the electrostatic air cleaner means 10. A grill 23 forms part of the intake air means for the electrostatic air means 10, while the grill work 24 forms a discharge air means for the electrostatic air means 10. A control panel 25 is also disclosed along with the exhaust air means 16.

It will be understood that the grill work 23 and 24 is the part visible in the ceiling of a room or space in which the electrostatic air cleaner means 10 is installed. The electrostatic air cleaner means 10 includes a fan (shown in FIG. 3) that draws intake air through the grill 23. The air is treated by the electrostatic air cleaner means 10 to remove particulate material, and then is discharged from the grill 24 back into the room where the air quality is being controlled.

Figure 3:
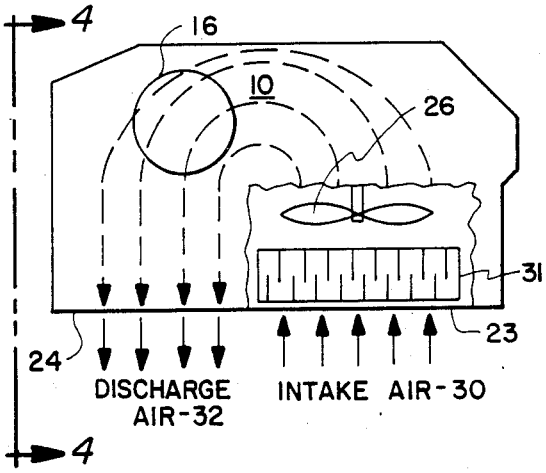
FIG. 3 is an elevation of an electrostatic air cleaner means with the invention.

In FIG. 3 the general function of the electrostatic air cleaner means 10 is shown. Intake air 30 is shown passing through the grill 23 to an electrostatic air cleaner cell 31 where particulate matter is held in suspension. The cell 31 can be removed for washing or cleaning at appropriate intervals. A fan 26 pulls the intake air 30 into the electrostatic air cleaner means 10 through the cell 31 and discharges the air through the grill 24 as discharge air 32. The discharge air has had the particulates, such as cigarette smoke, removed from it. Unfortunately, an electrostatic air cleaner means 10 does not remove all odor, carbon monoxide, carbon dioxide, and other objectionable materials in the air. Some means must be provided to properly ventilate the room in which the electrostatic air cleaner means 10 is installed in addition to the intake air 30 and the discharge air 32.

To accomplish this the exhaust air means 16 is provided on the side of the electrostatic air cleaner means 10 and, as was shown in FIG. 1, vents to a return air system in the plenum 20 or to the duct 21. A portion of the intake air 30 is diverted to the exhaust means 16, by an arrangement disclosed in FIG. 4.

Figure 4:
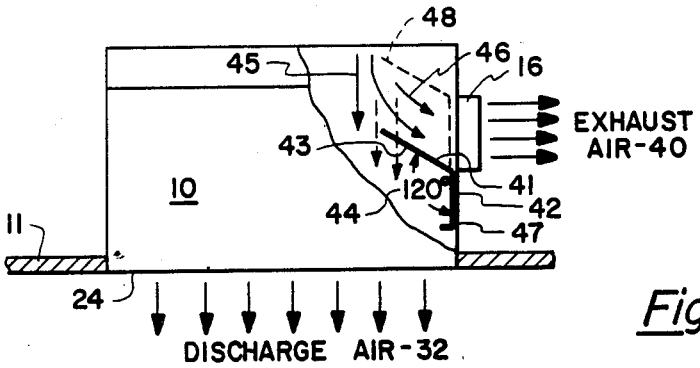
FIG. 4 is a partial cross-section of the electrostatic air cleaner of FIG. 3.

In FIG. 4 an end view is disclosed of an electrostatic air cleaner means 10 suspended above the false or dropped ceiling 11. This view is of the side adjacent the grill 24 or the discharge air 32 side of the unit. The grill 24 is disclosed along with the discharge air 32. The exhaust air means 16 is disclosed with exhaust air 40. The exhaust air 40 is generated by a means that will now be described.

Within the electrostatic air cleaner means 10 is a moveable vent closure means 41 made up of a sealing portion 42 and an air diverting portion 43. Typically this would be a piece of sheet metal and the sealing portion 42 would be mounted adjacent to the exhaust air means 16. An extension or air diverting portion 43 would extend from the sealing portion 42 and would form an obtuse angle that has been shown at 44 as approximately 120 degrees. This obtuse angle has been found to be effective to remove approximately 20 percent of the air flowing towards the grill 24 as the discharge air 32. The air flow is schematically shown at 45 as bypassing the air diverting portion 43, and at 46 as being diverted into the exhaust gas means 16.

The moveable vent closure means is mounted at 47 in a pair of slide-like members that allows the moveable vent closure means to be placed in the fully opened position (as shown in solid) or in a fully closed position (as shown in phantom) at 48. Any adjustment between these two positions can be accomplished and regulates the exhaust air 40 to any range between zero and 20 percent of the total air flowing through the electrostatic air cleaner means 10.

As can be seen, the moveable vent closure means 41 can be moved up and down to any intermediate position either allowing complete access to the exhaust air means 16, or blocking any or all of the exhaust air means 16. In this way the air diverter portion 43 picks off the selected amount of air flow for venting to the return air plenum 20 and duct 21.

With this arrangement it is possible to vent part of the treated air flow through the electrostatic air cleaner means 10 to an external area. This causes a slight vacuum or suction in the room in which the air quality is being controlled. As a result fresh air infiltrates either from the normal heating and ventilating system or around the openings into that room. This allows for a good control of the air quality in the room in which the electrostatic air cleaner means 10 is installed.

The applicant has disclosed a preferred embodiment of the present invention. It is obvious that the exact structure for carrying out this invention could be modified and the applicant wishes to be limited in the scope of his invention solely by the scope of the appended claims.

The embodiments of the invention in which an exclusive property or right is claimed are defined as follows:

1. An electrostatic air cleaner means for control of the air quality in a room and adapted to be mounted in a drop or false ceiling of said room, including: electrostatic air cleaner means having intake air means and discharge air means mounted in a plane that generally coincides with the plane of said false ceiling for said room in which said electrostatic air cleaner means is installed; said electrostatic air cleaner means creating an air flow into said intake air means where said air flow is treated; said treated air flow being subsequently discharged from said electrostatic air cleaner means; exhaust air means opening above said false ceiling and adapted to vent part of said treated air flow above said false ceiling; said exhaust air means having moveable vent closure means; said vent closure means including a sealing portion and air diverting portion with said air diverting portion being adjustably positioned in said treated air flow to deflect a portion of said air flow through said exhaust air means; and said sealing portion of said vent closure means being moved to a position to regulate the amount of said treated air flow that is vented through said exhaust air means and away from said room in which said electrostatic air cleaner means is installed.

2. An electrostatic air cleaner means as claimed in claim 1 wherein said air diverting portion of said vent closure means includes an air deflecting surface that forms an obtuse angle with respect to said sealing portion.

3. An electrostatic air cleaner means as claimed in claim 2 wherein said obtuse angle is approximately 120 degrees.

4. An electrostatic air cleaner means as claimed in claim 1 wherein said moveable vent closure means includes guide means that provides for slideably adjusting the position of said vent closure means in said exhaust air means to properly regulate the portion of said treated air flow that is vented away from said room.

5. An electrostatic air cleaner means as claimed in claim 4 wherein said air diverting portion of said vent closure means includes an air deflecting surface that forms an obtuse angle with respect to said sealing portion.

6. An electrostatic air cleaner means as claimed in claim 5 wherein said obtuse angle is approximately 120 degrees.

7. An electrostatic air cleaner means a claimed in claim 6 wherein said air deflecting surface is effectively removed as an air deflection element of said treated air flow when said vent closure means is in a closed position.

* * * * *